US005803825A

United States Patent [19]

Hamilton

[11] Patent Number: 5,803,825

[45] Date of Patent: Sep. 8, 1998

[54] GOLF PUTTER HEAD

[75] Inventor: Richard F. Hamilton, Murietta, Calif.

[73] Assignee: Rick Hamilton Golf Co., Inc., Murietta, Calif.

[21] Appl. No.: 928,449

[22] Filed: Sep. 12, 1997

[51] Int. Cl.[6] ..... A63B 53/04

[52] U.S. Cl. ..... 473/252; 473/332; 473/341; 473/342

[58] Field of Search ..... 473/251, 313, 473/329, 340, 341, 350, 349, 252, 223, 224, 234, 256, 291, 332, 342

[56] References Cited

U.S. PATENT DOCUMENTS

| | | | |
|---|---|---|---|
| 3,652,093 | 3/1972 | Reuter | 473/340 |
| 4,121,832 | 10/1978 | Ebbing | 473/340 |
| 5,437,447 | 8/1995 | Rigutto | 473/251 |

*Primary Examiner*—Sebastiano Passaniti

*Attorney, Agent, or Firm*—Michael A. Paint

[57] ABSTRACT

A golf putter head incorporating a resonating cavity which provides acoustic indicia of optimum contact between the putter head and a golf ball. A putter head in accordance with the present invention comprises a main weighted body and a striking member secured thereto. The main weighted body has a striking face which is intended to be substantially perpendicular to the putting surface. A cavity of predetermined geometry is centrally disposed into a recessed portion of the striking face of the weighted body. A striking plate is adapted to be frictionally engaged within the face recess. A cavity which is a mirror image of that disposed in the main weighted body is disposed in the striking plate. When the striking plate is frictionally inserted within the recess in the face of the weighted body, the cavities disposed in the respective members are placed in abutment to one another thereby creating a unitary, resonating cavity fully bounded by the surfaces of the adjacent main weighted body and the striking plate. When the striking plate contacts a golf ball along the axis of the resonating cavity, enhanced acoustic indicia will be produced.

8 Claims, 1 Drawing Sheet

GOLF PUTTER HEAD

BACKGROUND OF THE INVENTION

1. Field of the Invention

The present invention generally relates to golf clubs, and more particularly to golf putters.

2. Prior Art

Gaining proficiency in the game of golf requires the golfer to master the putting stroke. Although golfing strokes vary from individual to individual, all putting strokes require the putter to be moved in a pendulum fashion with the momentum imparted to the ball being controlled by the back swing of the club as well as the impact velocity of the club face upon the ball at the moment of contact. To meet these objectives, the prior art discloses numerous designs for golf putters which seek to form the putter head in a configuration which aids the initiation of the back swing and follow through as well as to maximize the momentum transferred to the ball upon impact.

In full recognition of the important part putting plays in the game of golf, numerous putter head designs are disclosed in the prior art. The structure of putter heads range from conventional blade designs to offset putter heads, to mallet designs and even those which exhibit the configuration of an I-beam. Recent designs disclosed by the prior art even offset the placement of the center of gravity of the putter head at different locations. Irrespective of the designs, all have the objective of improving the golfer's back swing, stroke and, most importantly, contact between the golf putter and the ball.

With the advancements in golf club construction, more radical designs have been created. A recent design disclosed by the prior art employs a putter head which includes an insert which is disposed within the striking area of the putter face where the club impacts the golf ball. One of the purposes of such an insert is to improve the golfer's recognition of the optimum location of the putter face where the golf ball is to make impact. In those golf putters which employ inserts, the insert is generally a solid material which is intended to enhance contact between the ball and the face of the putter. The inadequacy of conventional putter designs as well as those which employ inserts for the putter heads is based upon the failure to provide means for training the golfer to recognize the optimum location of contact between the face of the putter head and the golf ball.

All putter heads disclosed in the prior art exhibit some form of inadequacy. The primary inadequacy is that, irrespective of intent, the golfer is not provided with any feedback or other indicia which would permit the golfer to recognize the point of proper impact between the putter head and the golf ball. The present invention resolves this inadequacy by providing means for generating acoustic indicia when the golf ball has impacted the putter head face at the optimum location. To achieve this objective, the present invention putter head employs a main weighted body into which a cavity is disposed. A striking plate is adapted to be frictionally fit into the recess, the striking plate having a mating cavity disposed therein which is the mirror image of that formed in the weighted body. The enclosed cavity formed from the adjacent weighted body and striking plate therefore creates an internal void which is fully bounded by the adjacent surfaces of the weighted body and the striking plate. When the striking plate impacts the golf ball along the longitudinal axis of the cavity, the sound created will resonate and thereby produce audible indicia which will distinguish the optimum impact point from other locations which will generally result in less efficient impact between the putter head and the golf ball.

SUMMARY OF THE INVENTION

The present invention comprises an improved design for a golf putter head. The head is constructed of a main, weighted body into which a striking plate is fully engaged. The main weighted body can be of any shape. However, for the purpose of example only, the present invention is illustrated through the use of an ellipsoid construction. A uniform recess is formed in the striking face of the weighted body. The weighted body of the putter head has a selected axis of impact which is determined to be the optimum location of contact. A cavity of predetermined geometry is formed within the recess of the weighted body. A striking plate is adapted to be frictionally engaged within the recess of the weighted body. The cavity is formed in the surface of the striking plate and is a mirror image of that formed in the weighted body, the two cavity portions being adapted to be in abutment with one another along the axis of the club head when the striking plate is engaged with the weighted body.

When the putter head contacts a golf ball, acoustic energy is released. The cavity acts as a resonator. When contact is made along the axis of the resonating cavity, the result will be an enhanced audible sound or tone which will distinguish contact at the axis of the putter head from contact at a less favorable position on the club face.

It is therefore an object of the present invention to provide an improved golf putter head.

It is another object of the present invention to provide a golf putter head which provides distinguishable acoustic indica upon optimum contact between the putter head and a golf ball.

It is still another object of the present invention to provide an improved golf putter head which incorporates a resonant cavity to indicate contact at the striking axis of the putter head.

It is still yet another object of the present invention to provide an improved golf putter head which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
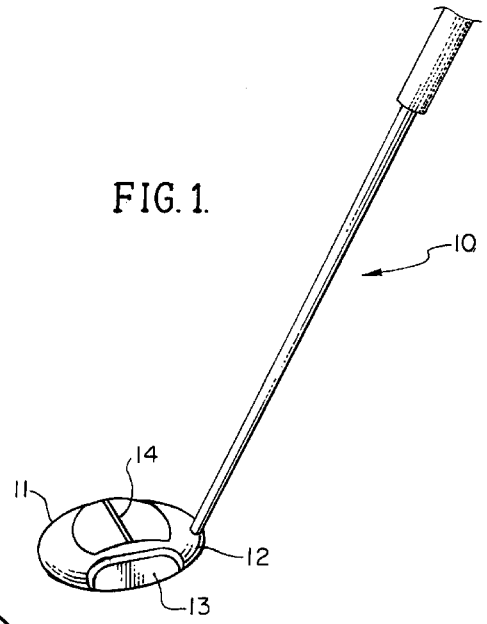
FIG. 1 is a front perspective view of a golf putter employing a putter head in accordance with the present invention.
Figure 2:
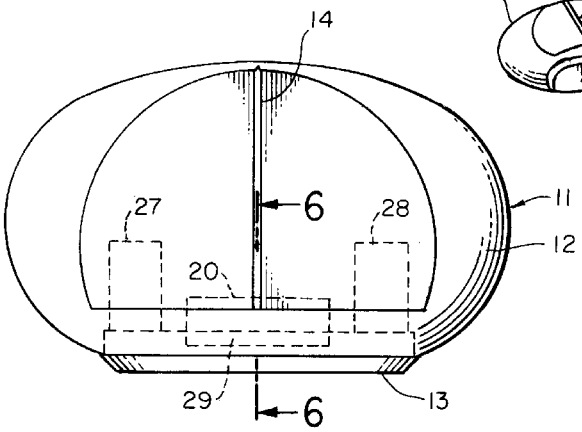
FIG. 2 is a top plan view of the putter head shown in FIG. 1.

A golf putter 10 employing a putter head 11 in accordance with the present invention may be best seen in FIGS. 1 and 2. Putter head 11 is constructed of a weighted body 12 and a striking plate 13. Although the weighted body 12 used to implement putter head 11 is shown to be an ellipsoid, the illustrated configuration of weighted body 12 is understood to be for the purpose of example only and is not intended to limit the application of the present invention. The principles of the present invention may be employed with a putter head 11 which uses a weighted body 12 having conventional configurations.

A proper putting stroke necessitates the putter 10 be moved in a pendulum fashion with the momentum of putter head 11 being imparted to a ball (not shown) through control of the back swing of the putter 10 as well as impact velocity of the putter head 11 in general, and striking face 13 in particular, upon the ball at the moment of contact.

All putter designs are deemed to have a point of optimum contact. With respect to putter head 11, weighted body 12 is illustrated having a longitudinal axis 14 or alignment guide which, in the example shown, lies along the center of gravity of weighted body 12. As shown in FIG. 2, weighted body 12 is an ellipsoid, alignment guide 14 generally bisecting the major axis of the ellipsoid.

Striking plate 13 is interfaced with weighted body 12 at surface 15 which is substantially perpendicular to alignment guide 14. Surface 15 is formed to include a recess 16 which extends rearwardly into weighted body 12. Base 17 of recess 16 is substantially parallel to surface 15 and is perpendicular to alignment guide 14.

Positioning apertures 18 and 19 are formed in base 17 of recess 16. Positioning apertures 18 and 19 are disposed in parallel spaced relation to each other and are perpendicular to surface 17. Positioning apertures 18 and 19 extend rearwardly into weighted body 12 a distance which is sufficient to frictionally secure striking plate 13, which will be described in detail hereinbelow.

In order to implement the present invention, depression 20 is disposed into base 17 of recess 16 and is uniformly placed intermediate positioning apertures 18 and 19. As will be described in detail hereinbelow, depression 20 forms a portion of a resonating cavity which will produce distinguishable audible indicia upon contact between club head 12 and a golf ball. Although depression 20 is shown to be in a substantially oval configuration, the geometry of depression 20 is one of choice.

Figure 4:
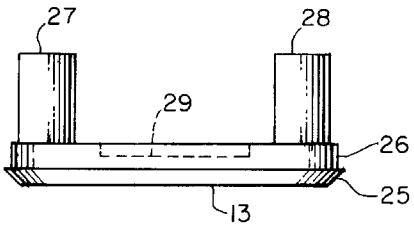
FIG. 4 is a top plan view of the striking plate of the putter head shown in FIG. 2.
Figure 3:
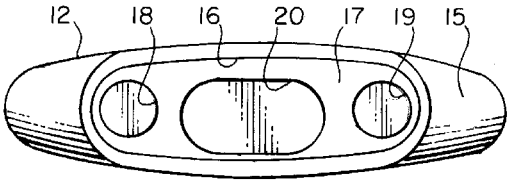
FIG. 3 is a side elevation view of the main weighted body of a putter head in accordance with the present invention.
Figure 5:
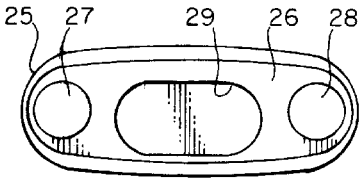
FIG. 5 is a rear elevation view of the striking plate shown in FIG. 4.

Striking plate 13 can be best seen by reference to FIG. 4 and FIG. 5. Striking plate 13 comprises a striking face 25 which is fully contiguous with surface 15 of weighted body 12. Striking face 25 extends into a uniformly positioned platform 26 which is adapted to be fully received within recess 16. Positioning pins 27 and 28 extend upwardly from platform 26 and are in parallel spaced relation to each other. Positioning pins 27 and 28 are in parallel spaced relation to each other and are adapted to be received within and frictionally engage positioning apertures 18 and 19 respectively.

As stated hereinabove, to achieve the objectives of the present invention, a resonating cavity is formed within the structure of putter head 12. To meet this objective, depression 29 is formed in platform 26 intermediate positioning pins 27 and 28. Depression 29 is a mirror image of depression 20 formed in base 17 of recess 16. As will be described in detail hereinbelow, when striking plate 13 is secured within weighted body 12, depressions 20 and 29 will be in abutment with one another creating a resonating cavity which will provide the means to create audible indicia reflecting contact with a golf ball at alignment guide 14.

Figure 6:
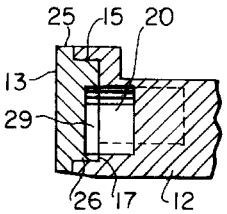
FIG. 6 is a partial, cross-sectional view of the putter head shown in FIG. 2 taken through line 6—6 of FIG. 2.

A cross-sectional view of the assembled weighted body 12 and striking plate 13 can be best seen by reference to FIG. 6. As can be seen, striking plate 13 fully engages weighted body 12. Striking face 25 is adjacent surface 15, platform 26 being disposed within recess 16 and is adjacent base 17. To implement the objective of the present invention, depressions 20 and 29 are fully contiguous with each other, the combination thereof forming the resonant cavity essential to producing distinguishable audible indica of optimum contact with a golf ball.

As described hereinabove, the audible indicia of contact is the result of the acoustic energy created by the impact between striking plate 13 and a golf ball. To enhance the characteristics of the present invention, weighted body 12 is constructed of an acoustically reflective material such as aluminum. Striking plate 13 is constructed of material which will enhance the transmission of acoustical energy therethrough such as copper. To preclude degradation or absorption of the acoustical energy created as a result of impact with a golf ball, striking plate 13 is secured to weighted body 12 solely through frictional engagement. No adhesives or other bonding agents are used which would attenuate sound transmission.

Figure 7:
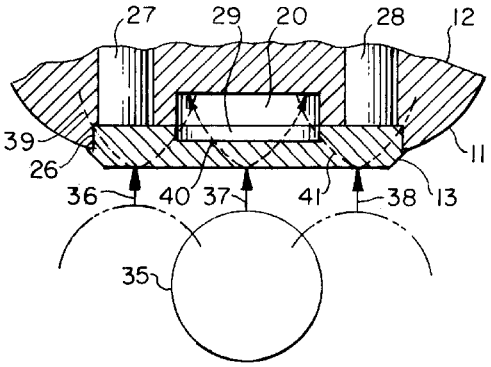
FIG. 7 is a schematic view of the transmission of acoustic energy in a putter head constructed in accordance with the present invention.

The operation of the present invention can be best seen by reference to FIG. 7 wherein a schematic illustration of contact between club head 11 and a golf ball 35 are shown. Golf ball 35 is shown impacting striking plate 13 at locations 36, 37 or 38 along the face of striking plate 13. Location 37 is considered to depict optimal contact at alignment guide 14 (see FIG. 2). As described, depressions 20 and 29 combine to form a fully enclosed, resonant cavity. The acoustic energy created by contact between golf ball 35 and locations 36, 37 and 38 is schematically depicted by acoustic transmission waves represented by reference numerals 39, 40 and 41, respectively. All sound waves impinging upon the resonant cavity formed by depressions 20 and 29 will produce echoes resulting from the reflection of the acoustic energy from the surfaces of depressions 20 and 29. As can be seen by comparing the acoustic energy resulting from contact at location 37 versus that resulting from contact at location 36 and 38, the amount of acoustic energy which will be reflected at location 37 is substantially greater. In meeting the objective of the present invention, the resonating cavity formed by depressions 20 and 29 will created audible indicia of optimal contact along alignment guide 14. Since this is distinguishable from other locations along striking plate 13, it will act as a training aid for improvement of the golfer's putting stroke.

I claim:

1. A golf putter head comprising:

(a) a weighted body having forward, rearward, top and bottom surfaces, a central recess being formed in said forward surface;

(b) a first uniform depression located in said recess;

(c) a striking plate having forward and rearward surfaces having an elevated member uniformly depending from said rearward surface;

(d) means for securely coupling the rearward surface of said striking plate to the forward surface of said weighted body, said elevated member being disposed within said recess; and (e) a second uniform depression disposed in the elevated member, said first and second depressions forming a resonant cavity when the forward surface of said weighted body and said rearward surface of said striking plate are adjacent one another.

2. A golf putter head as defined in claim 1 further including an alignment guide disposed in the top surface of said weighted body.

3. A golf putter head as defined in claim 2 wherein said resonant cavity is uniformly aligned with said alignment guide.

4. A golf putter head as defined in claim 1 wherein said means for securely coupling comprises first and second alignment apertures disposed in said recess on opposite sides of said first uniform depression and first and second alignment pins depending rearwardly from said elevated member on said opposite sides of the second uniform depression, said first and second alignment pin being adapted to frictionally engage said alignment aperture.

5. A golf putter head as defined in claim 1 wherein said first and second uniform depression comprise a void defined by the forward surface of said weighted body and the rearward surface of said striking plate whereby the impact of the forward surface of the striking plate and a golf ball create distinguishable, audible indicia.

6. A golf putter head comprising:

(a) a weighted body having forward, rearward, top and bottom surfaces, a central recess being formed in said forward surface and including a first, uniform depression centrally located within said recess and first and second alignment apertures formed in said recess on opposite sides of said first uniform depression;

(b) a striking plate having forward and rearward surfaces and having an elevated member uniformly depending from said rearward surface, said elevated member being adapted to be frictionally secured within said recess and a second uniform depression formed in said elevated member which is a mirror image of said first uniform depression;

(c) first and second alignment pins depending rearwardly from said elevated member on opposite sides of said second uniform depression, said first and second alignment pins adapted to be frictionally engaged within said first and second alignment apertures respectively.

7. A golf putter head as defined in claim 6 further including an alignment guide formed in the top surface of said weighted body.

8. A golf putter head as defined in claim 6 wherein said first and second uniform depressions form a resonant cavity when said striking plate is frictionally engaged with said weighted body.

* * * * *